US006428428B1

(12) United States Patent
Kuttappa et al.

(10) Patent No.: US 6,428,428 B1
(45) Date of Patent: Aug. 6, 2002

(54) LARGE CORE GOLF BALL

(75) Inventors: Sanjay M. Kuttappa, Clemson, SC (US); Lane D. Lemons, Jackson, TN (US); Matthew B. Stanczak, Westminster, SC (US)

(73) Assignee: Dunlop Maxfli Sports Corp., Westminster, SC (US)

( * ) Notice: Subject to any disclaimer, the term of this patent is extended or adjusted under 35 U.S.C. 154(b) by 0 days.

(21) Appl. No.: 09/483,641

(22) Filed: Jan. 14, 2000

Related U.S. Application Data

(60) Provisional application No. 60/138,079, filed on Jun. 8, 1999.

(51) Int. Cl.[7] ..... A63B 37/06
(52) U.S. Cl. ..... 473/378
(58) Field of Search ..... 473/378–384, 473/367, 368, 377

(56) References Cited

U.S. PATENT DOCUMENTS

| | | | | | |
|---|---|---|---|---|---|
| 4,762,326 | A | | 8/1988 | Gobush | 273/232 |
| 4,877,252 | A | | 10/1989 | Shaw | 273/232 |
| 4,932,664 | A | * | 6/1990 | Pocklington et al. | 473/378 |
| 5,092,604 | A | * | 3/1992 | Oka | 473/378 |
| 5,564,708 | A | | 10/1996 | Hwang | 473/382 |
| 5,700,209 | A | | 12/1997 | Sugiura | 473/380 |
| 5,709,618 | A | | 1/1998 | Hwang | 473/382 |
| 5,733,207 | A | * | 3/1998 | Sullivan et al. | 473/377 |
| 5,735,756 | A | | 4/1998 | Stiefel et al. | 473/382 |
| 5,807,192 | A | * | 9/1998 | Yamagishi et al. | 473/377 |
| 6,126,559 | A | * | 10/2000 | Sullivan et al. | 473/378 |

* cited by examiner

*Primary Examiner*—Mark S. Graham
*Assistant Examiner*—Raeann Gordon
(74) *Attorney, Agent, or Firm*—Lorusso & Loud

(57) ABSTRACT

A two piece golf ball has a core compression in the range of 67 PGA to 77 PGA, a core diameter in the range of about 1.535 inches to 1.545 inches, a cover hardness in the range of 65 to 71 Shore D, and a dimple pattern based on the geometry of a rhombicosadodecahedron. An uninterrupted equatorial great circle path, corresponding to a mold parting line, is provided in the design for forming a cover of the golf ball in two parts. A ball having such characteristics exhibits superior distance performance without compromising shot-making feel.

22 Claims, 13 Drawing Sheets

12
202
200
10
200
202
204
204
202
200
200
202
200
204
204
204

LARGE CORE GOLF BALL

CROSS-REFERENCE TO RELATED APPLICATIONS

A claim of benefit is made to U.S. Provisional Application Ser. No. 60/138,079 filed Jun. 8, 1999, the contents of which are incorporated herein by reference. This is a continuation-in-part application of the provisional application filed Jun. 8, 1999, the contents of which are incorporated herein by reference.

BACKGROUND OF THE INVENTION

The instant invention is directed to golf balls, and more particularly to a ball having the optimal core compression, core diameter, cover hardness, and dimple configuration to provide superior playability capabilities with respect to softness and spin without sacrificing superior distance capabilities.

DESCRIPTION OF THE PRIOR ART

It is well known in the golf industry that the distance a ball travels is one of the key features that distinguish one ball from the next. In the golf ball business, distance sells.

There are a number of physical properties that affect the performance of a golf ball. The core of the golf ball is the source of the ball's energy. Among other things, the core affects the ball's "feel" and its initial velocity. The "feel" is the overall sensation transmitted to the golfer through the golf ball after striking a ball. The initial velocity is the velocity at which the golf ball travels when first struck by the golf club. The initial velocity together with the ball's trajectory determine how far a shot will travel.

Until the late 1960's most golf balls were constructed as three-piece wound balls. In the three-piece wound ball, a solid or liquid-filled center is wound with rubber windings to form a core, which is then covered with a cover of compounds based on natural (balata or guttta percha) or synthetic transpolyisoprene. During the manufacturing process, after the liquid-filled center is formed, it is frozen to make it as hard as possible so that it will retain its spherical shape while the rubber thread is wrapped around it.

These three-piece wound balls were known and are still known to provide acceptable flight distance and soft feel. Additionally, due to the relative softness of the balata cover, skilled golfers are able to impart various spins on the ball in order to control the ball's flight path (e.g. "fade" or "draw") and "check" characteristics upon landing on a green.

With the advent of new materials developed through advances and experimentation in polymer chemistry, two-piece golf balls were developed. The primary difference between a two-piece golf ball and a three-piece golf ball is the elimination of the rubber thread windings found in the three-piece balls. A relatively large solid core in a two-piece ball takes the place of the relatively small center and thread windings of a three-piece ball core having the same Gverall diameter. With the elimination of the thread windings, there is no need to freeze the core during the manufacturing process of the two-piece golf ball.

Two-piece balls have proven to be more durable than three-piece balls when repeatedly struck with golf clubs and more durable when exposed to a variety of environmental conditions. An example of these environmental conditions is the high temperatures to which golf balls in an automobile trunk are commonly subjected. In addition, two piece balls are typically less expensive to manufacture than the three-piece wound balls. However, two-piece balls are, in general, considered to have inferior characteristics of feel and workability when compared to three-piece balls. Generally and historically, two piece balls use harder cover materials for increased durability. The "hardness" of a golf ball can affect the "feel" of a ball and the sound or "click" produced at contact. "Feel" is determined as the deformation (i.e. compression) of the ball under various load conditions applied across the ball's diameter. Generally, the lower the compression value, the softer the "feel." Consequently, two-piece golf balls have a higher initial velocity. In addition, typically two-piece golf balls have more potential energy, which is derived primarily from the core. The cores in two piece golf balls are typically larger than the centers in three-piece golf balls.

In contrast, three-piece golf balls with their smaller centers historically use softer cover materials. These softer cover materials result in a lower initial velocity when compared to two-piece golf balls. However, this difference in the initial velocity may be somewhat made up by the windings in the three-piece golf ball.

In addition to manipulating the core and cover of a golf ball, for many years golf balls have been made with surface indentations or depressions, called dimples, to improve their aerodynamic properties in flight. Specifically, ball manufacturers have looked to dimple configurations in an effort to design a ball with superior distance capabilities. Many efforts have been made to select the optimum number, size and shape of dimples as well as their disposition around the outer surface of a generally spherically shaped golf ball.

Ball manufacturers are bound by regulations of the United States Golf Association (USGA) which control many characteristics of the ball, including the size and weight of the ball, the initial velocity of the ball when tested under specified conditions, the overall distance the ball travels when hit under specified test conditions, and the ball's aerodynamic symmetry. Under USGA regulations, the diameter of the ball cannot be less than 1.680 inches, the weight of the ball cannot be greater than 1.620 ounces avoirdupois, the initial velocity of the ball cannot be greater than 250 feet per second when tested under specified conditions (with a maximum tolerance of +2%), the driver distance cannot exceed 280 yards when tested under specified conditions (with a test tolerance of +6%), and the ball must perform the same aerodynamically regardless of orientation.

While the USGA sets a limit for the distance a ball can travel under set test conditions, there is no upper limit on how far a player can hit a ball. For example, U.S. Pat. No. 4,886,277 discloses the projection of a truncated octahedron onto the ball as a basis for a dimple configuration. A truncated octahedron is formed by removing portions of the eight-sided octahedron, which results in a solid with six (6) squares, and eight (8) hexagons. The preferred ball disclosed in this reference has a minimum of four (4) uninterrupted great circle paths present on the dimpled ball, and a major portion of the dimples present on the ball are within the boundaries of either a spherical hexagon or square. U.S. Pat. No. 4,765,626 discloses a golf ball having a dimple pattern based on the truncated octahedron used in conjunction three orthogonal uninterrupted parting lines which coincide with the diagonal bisectors of the squares.

A problem with the prior art dimple configurations is that they fail to take into account other features of the ball, such as core size, core compression and cover hardness, which also influence how far a ball will travel.

U.S. Pat. No. 5,368,304 to Sullivan discloses a ball having a low spin rate, which in turn enables the ball to travel greater distances. According to the Sullivan patent, the low spin rate is the result of a soft core and hard cover. While the '304 patent discloses the use of a soft core and hard cover to lower the spin rate, it does not disclose a dimple configuration for the ball.

OBJECT OF THE INVENTION

Accordingly, it is an object of the instant invention to provide a two-piece golf ball that has a soft feel in combination with superior distance capabilities.

It is another object of the instant invention to optimize the combination of core compression, core size, core composition, dimple configuration, cover composition, and cover hardness to provide a two-piece golf ball, which travels great distances, and at the same time complies with USGA regulations.

It is yet another object of the instant invention to provide a two-piece golf ball having a synthetic cover material that achieves the sound, feel, playability and flight performance qualities of balata covered golf balls.

It is a further object of the instant invention to lower the cost of manufacturing a two-piece golf ball that has a soft feel in combination with superior distance capabilities.

It is still a further object of the instant invention is to provide a two-piece golf ball having superior distance, trajectory and flight stability.

Another object of the instant invention is to provide a two-piece golf ball having a surface divided into a plurality of polygonal configurations or shapes for the location of dimples for enhancing the aerodynamic properties of the golf ball.

SUMMARY OF THE INVENTION

The invention achieves the above-described objectives by providing a two-piece golf ball having a solid rubber core, a synthetic ionomer resin cover, and a "rhombicosadodecahedron" dimple pattern. The ball of the instant invention has a core compression in the range of 67 PGA to 77 PGA; a core diameter in the range of about 1.535 inches to about 1.545 inches; a cover hardness in the range of about 65 Shore D to about 71 Shore D, and a dimple pattern based on the geometry of a rhombicosadodecahedron. This combination has been found to produce a ball with superior distance capabilities, which also satisfies USGA regulations. The use of these properties in the golf ball of the instant invention is based on the recognition that it is the combination of the core compression, core composition, core size, cover composition, cover hardness, dimple configuration, dimple size and dimple shape that will produce a ball that will travel the greatest distance without compromising shot-making feel.

The cover material can be constructed from any relatively stiff material, for example, synthetic thermoplastic materials. Most notably these synthetic thermoplastic materials are ionomeric resins. Ionomeric resins are polymers containing interchain ionic bonding. As is well known in the chemical arts, ionomeric resins are generally ionic copolymers of an olefin having from about two to about eight carbon atoms, such as ethylene and a metal salt of an unsaturated carboxylic acid, such as acrylic acid, methacrylic acid, or maleic acid. The pendent ionic groups in the ionomeric resins interact to form ion-rich aggregates contained in a non-polar polymer matrix. Metal ions, such as sodium, zinc or magnesium are used to neutralize some portion of the acidic groups in the copolymer. This results in a thermoplastic elastomer, which exhibits enhanced flight characteristics and durability when compared to golf balls constructed with balata covers. However, the advantages gained by enhanced durability have been offset by the decreased playability properties.

The ionomers used in the cover composition are sold by E. I. Dupont De Nemours & Company under the name SURLYN®. In an attempt to overcome the negative factors of the hard jonomer covers, DuPont introduced low modulus SURLYN® ionomers in the early 1980's. These SURLYN® ionomers have a flexural modulus of from about 3000 to about 7000 PSI and hardness of from 25 to about 40 as measured on the Shore D scale—ASTM 2240. The low modulus ionomers are terpolymers, typically of ethylene, methacrylic acid and n or iso-butylacrylate, neutralized with sodium, zinc, magnesium or lithium cations. E. I. DuPont De Nemours & Company has disclosed that the low modulus ionomers can be blended with other grades of previously commercialized ionomers of high flexural modulus from about 30,000 to 55,000 PSI to produce balata-like properties. However, soft blends, typically 52 Shore D and lower (balata-like hardness), are still prone to cut and shear damage.

The low modulus ionomers when used without high flexural modulus blends produce covers with very similar physical properties to those of balata, including poor cut and shear resistance. Worse, wound balls with these covers tend to go "out-of-round" quicker than wound balls with balata covers. Blending with hard SURLYN® ionomers was found to improve these properties.

It has now been discovered that a blend of a high resilience ionomer with an associated medium to high acid level with improved flow ionomers containing high acid level results in a golf ball cover with improved playability characteristics. For the purposes of the SURLYN® ionomer resin grade designations, a high acid level is approximately 19% by weight, and a medium acid level is approximately 15% by weights.

As mentioned previously, in addition to manipulating the core and cover parameters in a golf ball, superior aerodynamic properties are also attributed to the dimple configuration on a golf ball. In the instant invention, the dimples are arranged on the surface of the golf ball based on the geometry of a rhombicosadodecahedron. This configuration is achieved by dividing the outer spherical surface of a golf ball into a plurality of polygonal configurations, including pentagons, squares and triangles for locating a plurality of dimples on the outer surface of the golf ball. The polygonal configurations of this invention are preferably a combination of regular pentagons, squares and triangles to cover the outer surface. This first plurality of polygonal configurations is generally referred to herein as a "rhombicosadodecahedron". The rhombicosadodecahedron is further characterized by a uniform pattern of pentagons formed over the outer surface each bounded by triangles and squares.

A pair of first polygonal configurations, each located on opposite sides of the outer surface, include one of the two poles symmetrically arranged within its boundaries. The outer surface has a plurality of dimples of different sizes. In one embodiment, the dimples are of first, second and third sizes and are generally located to have a first pattern associated with the pentagons, a second pattern associated with the squares, and a third pattern associated with the triangles. Dimples are preferably circular in shape, but can have a non-circular shape within the scope of this invention.

The combination of the aforementioned core, cover and dimple specifications produces a golf ball that possesses noticeable improvements in playability (i.e. softness in feel) without sacrificing the ball's durability (i.e. impact resistance etc.) which in turn relates directly to the distance a ball will travel when struck. In addition, the instant invention provides a golf ball composition that exhibits the desired properties of the three-piece wound ball (e.g. long distance in combination with a soft feel), but with the lower manufacture cost associated with the two-piece ball. These and other objects of the instant invention will be apparent from a reading of the following detailed description of the instant invention.

DETAILED DESCRIPTION OF THE PREFERRED EMBODIMENT

Figure 1:
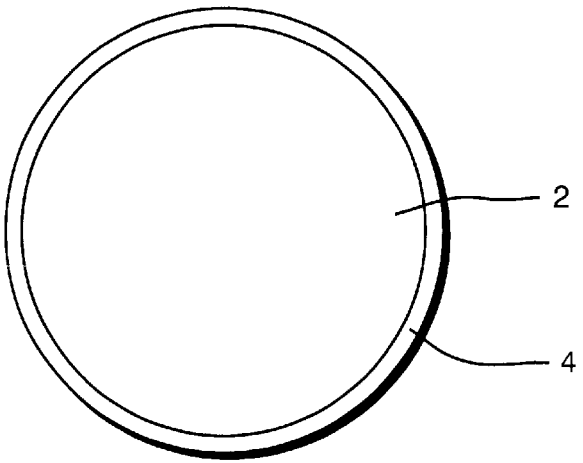
FIG. 1 is a cross sectional view of a two-piece golf ball made in accordance with one embodiment of the invention.

FIG. 1 shows a section view of a two-piece golf ball made in accordance with the preferred embodiment of the instant invention. A two-piece golf ball has a solid rubber core 2 and a cover 4. The solid rubber core 2 is manufactured by using conventional compression molding processes. The components are mixed together and extruded to form preforms, which are then placed in cavities in the mold and are compression molded under pressure and cured or vulcanized to form cores. The same mix may also be injection molded. Curing is carried out in the mold at temperatures of 280–380 degrees F. for five to twenty minutes depending on the compound. Once fully cured, the cores are removed from the mold cavities and prepared for application of a cover.

In the preferred embodiment, the golf ball core 2 is made of a solid rubber composition comprising a polybutadiene rubber center of a composition typical to the industry. Specifically, the rubber may be 90–100 PHR polybutadiene, 0–10 PHR polyisoprene, 20–35 PHR zinc diacrylate, 3–10 PHR zinc oxide, 0–30 PHR fillers, process aids and antioxidants, and 0.5–5 PHR peroxide initiator. In the preferred embodiment, the diameter of the solid rubber core 2 is about 1.540±0.005". The core 2 weighs about 36.75±0.25 grams, and has a compression of about 72±5 PGA.

As is well known in the art, the type and amount of crosslinking agents used to make the core will have the greatest influence on the core compression achieved. To prepare the core 2 according to the preferred embodiment, it has been found that a core composed primarily of high-cis polybutadiene in combination with cross-linking agents, activators, initiators and fillers (active and inactive), can be used to achieve a golf ball core having the desired compression characteristics. As used herein, high-cis means a cis isomer content of greater than 93%. It is to be understood that the core formula set forth herein is but one formula that can be used to make a core having the desired core compression.

Once formed, the solid rubber core 2 is then subjected to a conventional molding process whereby the SUTRLYN® cover 4 is injection molded around the core 2 in a manner well known to those skilled in the art. To make the cover, the blended components of the cover are injection molded into cavities, which contain cores suspended in the center of the cavities. The inner surfaces of the cavities are constructed with dimple-shaped projections, which form the dimples in the cover. The process used to make the cover is the standard process used and well known in the art wherein one or more components are added together to form a blend which is then injected into the mold. After molding, the golf balls produced may undergo further processing steps such as pressure blasting, vibratory finishing, stamping of the logo, application of a primer, and finally, application of a top coat.

In the preferred embodiment, the cover has a thickness of about 0.070" leading to provide a total diameter of core and cover of 1.680", the commercial ball diameter standard specified by the United States Golf Association.

As discussed previously, the cover material is comprised of ionomer resins available from E. I. du Pont de Nemours & Co. under the name SURLYN®. In the preferred embodiment, the ionomers are 45% by weight of SURLYN® 9150, 30% by weight SURLYN® 8150, and 25% by weight of SURLYN® 6910. The hardness of the cover is about 68±3 Shore D.

Under the Dupont SURLYN® resin classification system, the 9150 SURLYN® ionomer is classified as an improved-flow ionomer. This ionomer uses the Zinc metal ion to neutralize the acid groups, and its acid level is about 19% by weight, which is considered a high acid level to those skilled in the art. In turn, this high acid level is associated with a resin characterized by a high stiffness level. Moreover, the 9150 SURLYN® grade has no terpolymer. Finally, the 9150 SURLYN® resin has a melt index of about 4.5.

The 8150 SURLYN® resin is also classified as an improved-flow ionomer which has a high acid level of about 19% by weight, which in turn produces a resin characterized by a high stiffness level. The 8150 SURLYN® resin uses the sodium ion to neutralize the acid groups, and it does not employ a terpolymer. Finally, the 8150 SURLYN® resin has a melt index of about 4.5.

The 6910 SURLYN® resin is classified as a high resilience ionomer which has a medium acid level of about 15% by weight, which is considered a medium to high acid level to those skilled in the art. In turn, this acid level is associated with a resin characterized by a medium to high stiffness level. Moreover, the 6910 SURLYN® grade has no terpolymer. Finally, the 6910 SURLYN® resin has a melt index of about 0.9.

In addition to the SURLYN® resins, the cover composition contains color concentrate for coloring the golf ball in an amount well known to those skilled in the art.

Turning now to the dimple technology employed in the instant invention, as stated previously, the preferred geometry is a rhombicosadodecahedron. Accordingly, the scope of this invention provides a golf ball mold whose molding surface contains a uniform pattern to give the golf ball a dimple configuration superior to those of the art. The invention is preferably described in terms of the golf ball that results from the mold, but could be described within the scope of this invention in terms of the mold structure that produces a golf ball.

Figure 2:
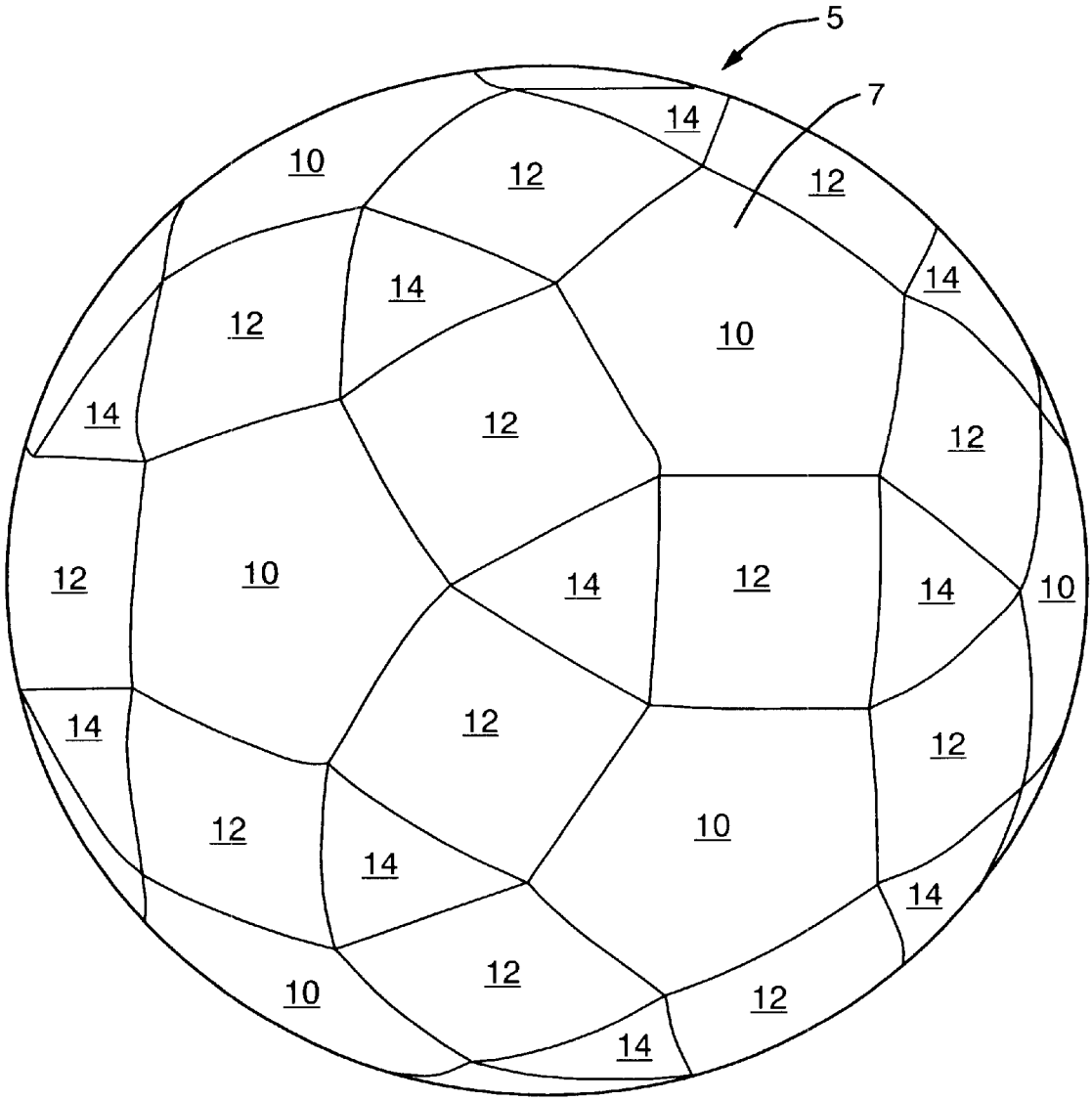
FIG. 2 is an elevation view of the outer surface of a golf ball being divided into a plurality of polygonal configurations according to the invention.

To assist in locating the dimples on the golf ball, the golf ball of this invention has its outer spherical surface partitioned by the projection of a plurality of polygonal configurations onto the outer surface. That is, the formation or division that results from a particular arrangement of different polygons on the outer surface of a golf ball is referred to herein as a "plurality of polygonal configurations." A view of one side of a golf ball 5 showing a preferred division of the golf ball's outer surface 7 is illustrated in FIG. 2.

In the preferred embodiment, a polygonal configuration known as a rhombicosadodecahedron is projected onto the surface of a sphere. A rhombicosadodecahedron is a type of polyhedron, which contains thirty (30), squares, twenty (20) polyhedra of one type, and twelve (12) polyhedra of another type. The term "rhombicosadodecahedron" is derived from "dodecahedron," meaning a twelve (12) sided polyhedron; "icosahedron," meaning a twenty (20) sided polyhedron, and "rhombus" meaning a four sided polyhedron.

The rhombicosadodecahedron of the preferred embodiment is comprised of thirty (30) squares 12, twelve (12) pentagons 10, and twenty (20) triangles 14. It has a uniform pattern of pentagons with each pentagon bounded by triangles and squares. The uniform pattern is achieved when each regular pentagon 10 has only regular squares 12 adjacent to its five boundary lines, and when a regular triangle 14 extends from each of the five vertices of the pentagon. Five (5) squares 12 and five (5) triangles 14 form a set of polygons around each pentagon. Two boundary lines of each square are common with two pentagon boundary lines, and each triangle has its vertices common with three pentagon vertices.

The outer surface of the ball is further defined by a pair of poles and an uninterrupted equatorial great circle path around the surface. A great circle path is defined by the intersection between the spherical surface and a plane, which passes through the center of the sphere. Although an infinite number of great circle paths may be drawn on any sphere, there is only one uninterrupted great circle path, which corresponds to a mold parting line, and which gives the ball enhanced aerodynamic properties as well as enhanced symmetry. The uninterrupted great circle path is uninterrupted as a result of being free of dimples. The uninterrupted equatorial equatorial great circle path in the preferred embodiment corresponds to a mold parting line, which separates the golf ball into two hemispheres. The mold parting line is located from the poles in substantially the same manner as the equator of the earth is located from the north and south poles.

Figure 3:
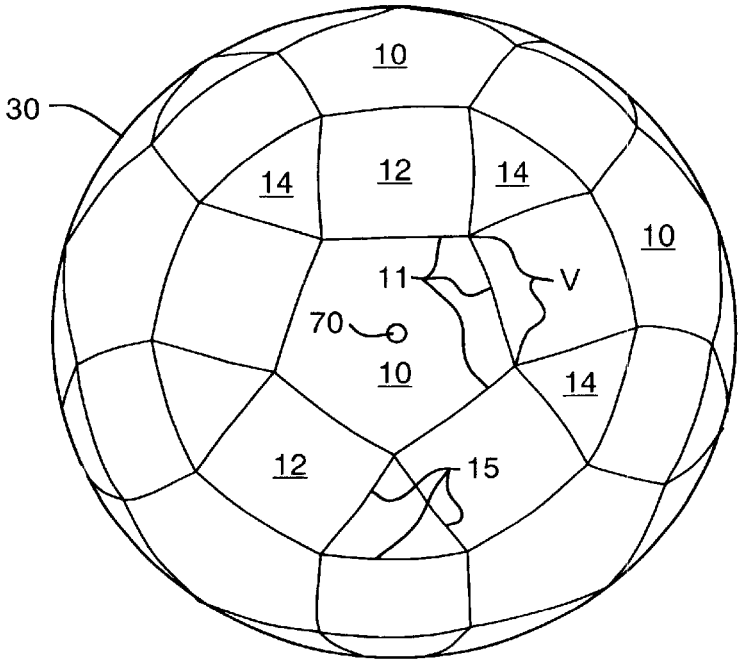
FIG. 3 is an elevation view of the golf ball of this invention showing the relative locations of pentagons, squares and triangles formed on the outer surface with a pole at the center of a pentagon.
Figure 4:
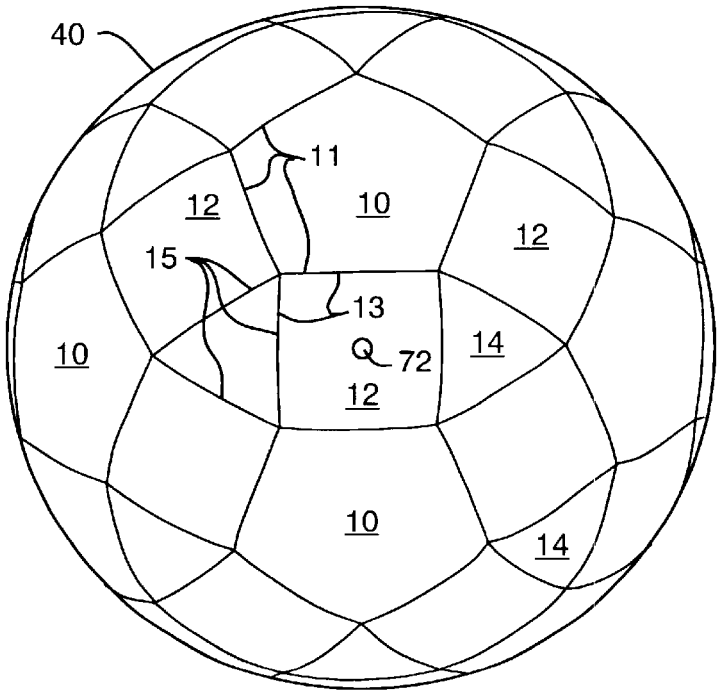
FIG. 4 is an elevation view of the golf ball of this invention showing the relative locations of pentagons, squares and triangles formed on the outer surface with a pole at the center of a square.
Figure 5:
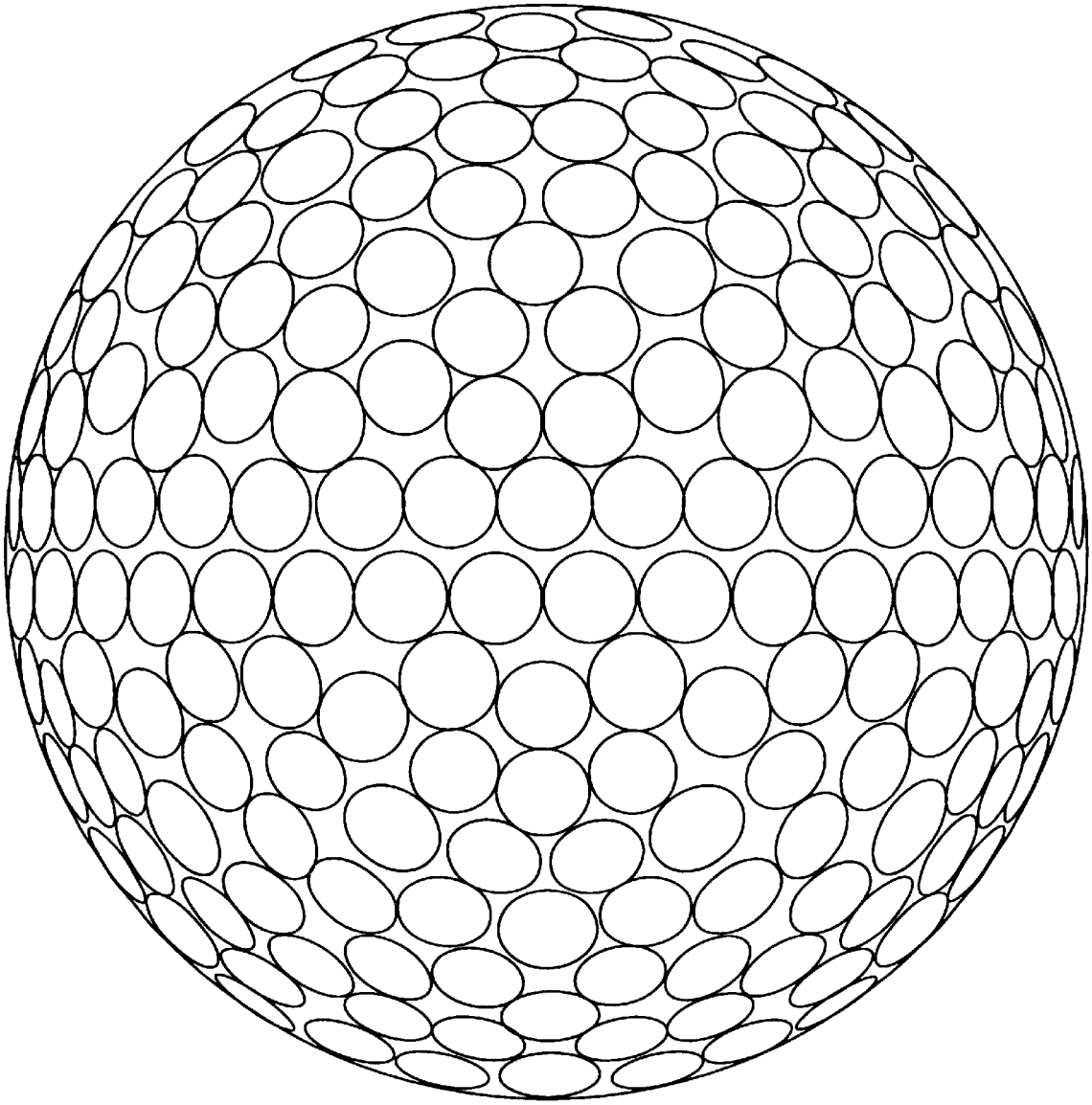
FIG. 5 is an equatorial view of the ball of preferred embodiment of the instant invention.
Figure 6:
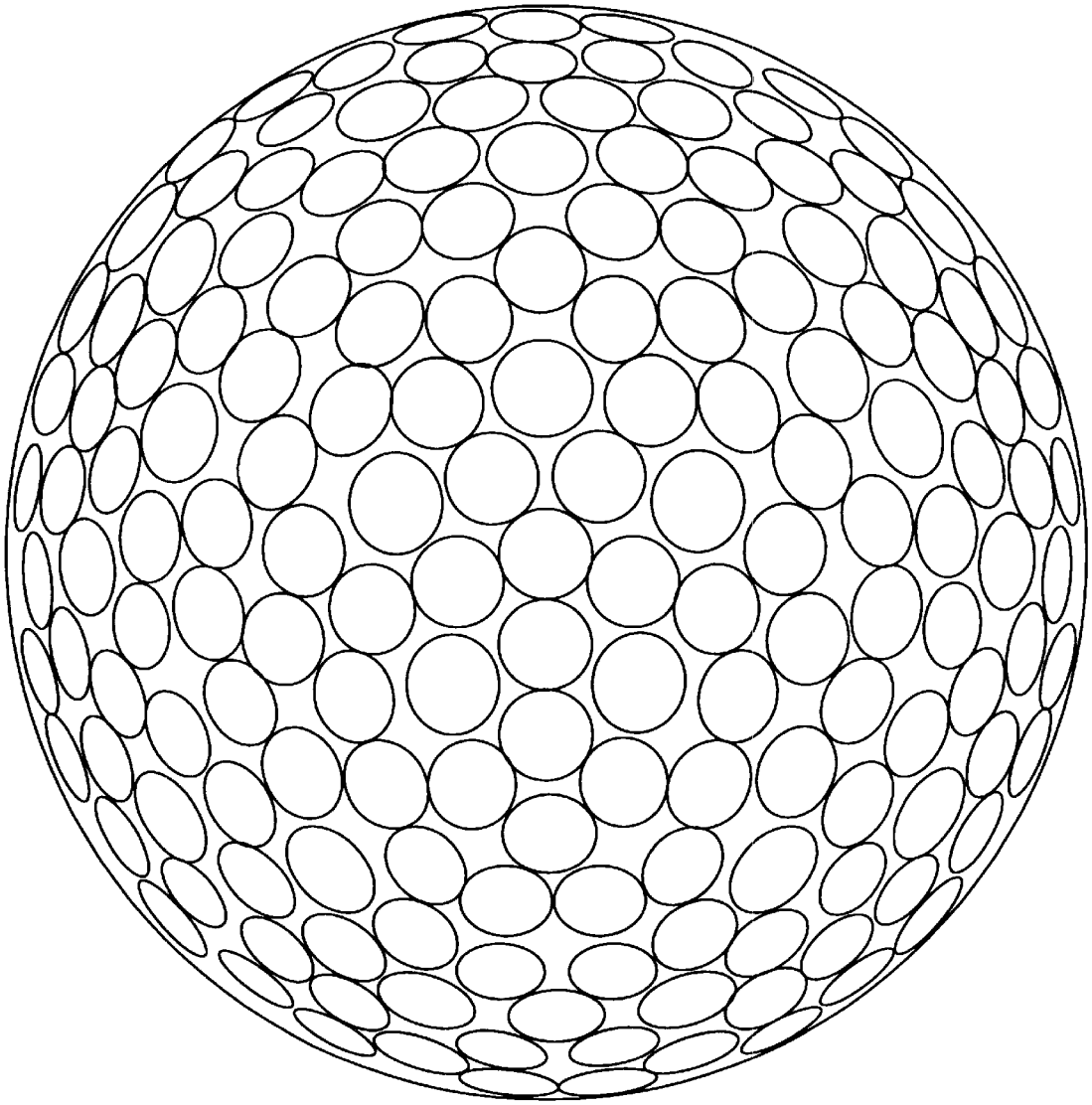
FIG. 6 is a polar view of the ball shown in FIG. 4.
Figure 7:
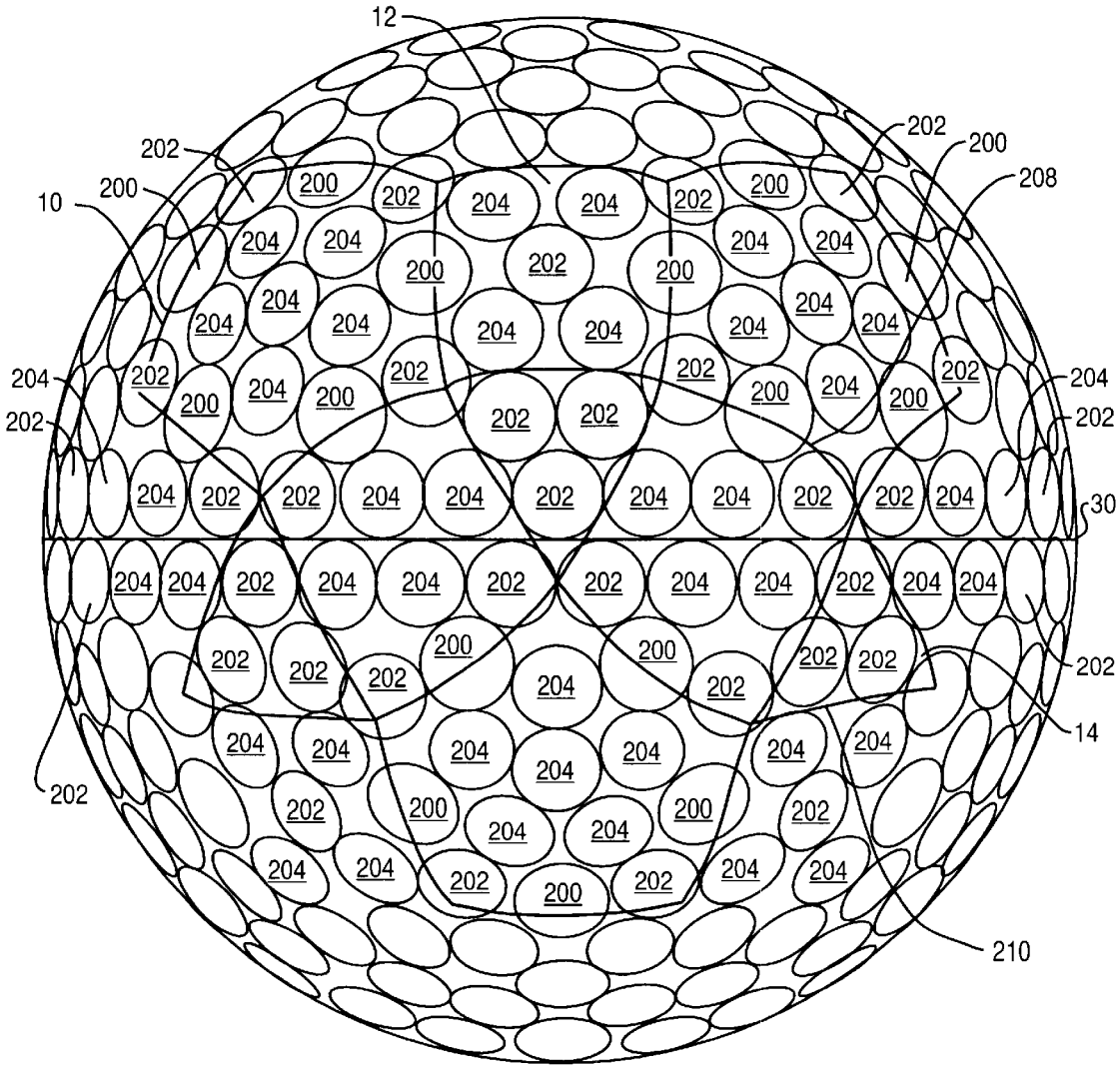
FIG. 7 is an equatorial view of the ball shown in FIG. 4, and includes the polygons projected thereon.

Referring to FIG. 3, the poles 70 are located at the center of a pentagon 10 on the top and bottom sides of the ball, as illustrated in this view of one such side. The mold parting line 30 is at the outer edge of the circle in this planar view of the golf ball. In the embodiment shown in FIG. 4, the poles 72 are both located at the center of the square on the top and bottom of the golf ball, as illustrated in this view of one such side. (The top and bottom views are identical.) The mold parting line 40 is at the outer edge of the circle in this planar view of the golf ball.

Dimples are placed on the outer surface of the golf ball based on segments of the plurality of polygonal configurations described above. In the preferred embodiment, three (3) dimples are associated with each triangle, five (5) dimples are associated with each square, and sixteen (16) dimples are associated with each pentagon. The term "associated" as used herein in relation to the dimples and the polyhedra means that the polyhedra are used as a guide for placing the dimples.

In the preferred embodiment, there are a total of 402 dimples. Advantageously, this decrease in the number of dimples when compared to prior art golf balls results in a geometrical configuration that contributes to the aerodynamic stability of the instant golf ball. Aerodynamic stability is reflected in greater control over the movement of the instant golf ball.

The dimple configuration of the preferred embodiment is shown in FIGS. 5–8. It is based on the projection of the rhombicosadodecahedron shown in FIG. 3. The ball has a total of 402 dimples. The plurality of dimples on the surface of the ball are selected from three sets of dimples, with each with each set having different sized dimples. Dimples 200 are in the first set, dimples 202 are in the second set, and dimples 204 are in the third set. Dimples are selected from all three sets to form a first pattern associated with the pentagon 10. All sides 206 of each pentagon are intersected by one dimple 200 from the first set of dimples and two dimples 202 from the second set of dimples. All pentagons 10 have the same general first pattern arrangement of dimples.

Dimples 200, 202 and 204 (from all three sets of dimples) are also used to form a second pattern associated with the squares 12. All sides 208 of each square 12 are intersected by dimples 202 from the second set of dimples, and all squares have the same general second pattern arrangement of dimples.

Dimples 202 from the second set of dimples form a third pattern associated with the triangles 14. All sides 210 of each triangle are intersected by a dimple 202 from this second set of dimples. All triangles have this same general third pattern arrangement of dimples. The mold parting line 30 is the only dimple free great circle path on this ball.

Advantageously, the use of a single uninterrupted mold parting line leads to superior aerodynamic properties in the instant golf ball. The single uninterrupted mold parting line results in less severe separation between the dimples, i.e.

fewer "bald spots" on the surface of the ball. This in turn increases the effectiveness of the dimples on the golf ball. Advantageously, increasing the effectiveness of the dimples by reducing the land area on the surface of the golf ball improves the aerodynamic properties of the instant golf ball with regard to distance and control.

A major radius (Radius 1) describes the bottom of the dimple (i.e. it governs the shape of the dimple toward the bottom of the dimple). A minor radius (Radius 2) governs the shape of the dimple about its circumference. As noted below, in some embodiments, these radii may be equal.

Figure 9:
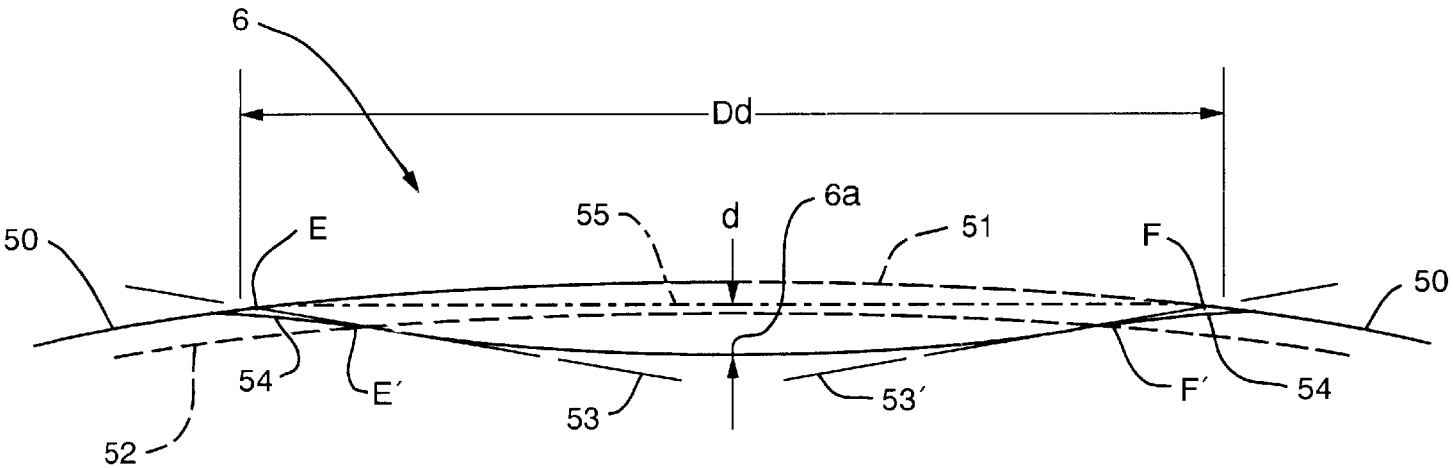
FIG. 9 is a cross sectional view cut through one of the dimples on the outer surface of the ball.

Dimple size is measured by a diameter and depth generally according to the teachings of U.S. Pat. No. 4,936,587 (the '587 patent), which is included herein by reference thereto. An exception to the teaching of the '587 patent is the measurement of the depth, which is discussed below. A cross-sectional view through a typical dimple 6 is illustrated in FIG. 9. The diameter Dd used herein is defined as the distance from edge E to edge F of the dimple. Edges are constructed in this cross-sectional view of the dimple by having a periphery 50 and a continuation thereof 51 of the dimple 6. The periphery and its continuation are substantially a smooth surface of a sphere. An arc 52 is inset about 0.003 inches below curve 50-51-50 and intersects the dimple at point E' and F'. Tangents 53 and 53' are tangent to the dimple 6 at points E' and F' respectively and intersect periphery continuation 51 at edges E and F respectively. The exception to the teaching of '587 noted above is that the depth d is defined herein to be the distance from the chord 55 between edges E an F of the dimple 6 to the deepest part of the dimple cross sectional surface 6 (*a*), rather than a continuation of the periphery 51 of an outer surface 50 of the golf ball.

In the preferred embodiment, dimples 200 from the first set have a diameter of 0.156 inches; dimples 202 from the second set have a diameter of 0.145 inches, and dimples 204 from the third set have a diameter of 0.140 inches. All dimples, 200, 202 and 204 have a depth of 0.0061 inches, and they are dual radius in cross section (i.e. dual radius dimples), which means that there is a major radius (radius 1) describing the bottom of the dimple, and a minor radius (radius 2) describing the side radius of the dimple.

Advantageously, the use of dimples that are dual radius in cross section improves the performance of the instant golf ball with respect to both distance and control of the movement of the golf ball. The presence of dual radius dimples allows for a soft trajectory in golf ball's flight. In turn, this soft trajectory leads to a soft entry of the golf ball onto the golf course green, which in turn results in greater control over the movement of the instant golf ball.

The major radius (radius 1) for all of the dimples in the preferred embodiment is 0.7874 inches, and the minor radius (radius 2) for all of the dimples is 0.1181 inches. However, it is understood that the following dimple size ranges are within the scope of this invention. Dimples 200 from the first set may have a diameter in the range of 0.154 inches to 0.158 inches; dimples 202 from the second set may have a diameter in the range of 0.145 to 0.148 inches; dimples 204 from the third set may have a diameter in the range of 0.13 to 0.14 inches; all dimples, 200, 202 and 204 may have a depth in the range of 0.0054 inches to 0.0064 inches; the major radius may be in the range of 0.75 to 0.80 inches; and the minor radius may be in the range of 0.10 inches to 0.12 inches. In some cases, the major radius may be equal to the minor radius.

The following examples are provided to illustrate and further explain the beneficial effects of the ball described above. These examples are set forth for the purposes of illustrating the advantages obtained with the combination of the core compression, core size, cover composition, cover hardness, cover thickness, dimple configuration, and dimple number that will produce a ball that will travel the greatest distance without compromising shot-making feel.

EXAMPLE 1

The following table summarizes key features of the control and test samples.

| XS Distance Golf Ball | Large Core Golf Ball |
|---|---|
| Core Data: | Core Data: |
| Diameter (inches) 1.509 ± 0.005" | Diameter (inches) 1.540 ± 0.005" |
| Weight (grams) 34.55 ± 0.35 g | Weight (grams) 36.00 ± 0.25 g |
| Compression (PGA) 75 ± 7 PGA | Compression (PGA) 72 ± 5 PGA |
| Cover Data: | Cover Data: |
| Thickness (inches) 0.085" | Thickness (inches) 0.070" |
| Hardness (Shore D) 68 ± 3 Shore D | Hardness (Shore D) 68 ± 3 Shore D |
| Composition (% by weight) | Composition (% by weight) |
| 45% Surlyn ® 9150 | 45% Surlyn ® 9150 |
| 30% Surlyn ® 8150 | 30% Surlyn ® 8150 |
| 25% Surlyn ® 6910 | 25% Surlyn ® 6910 |
| plus color concentrate | plus color concentrate |
| Dimple Data: | Dimple Data: |
| Geometrical Layout: | Geometrical Layout: |
| Icosadodecahedron | Rhombicosadodecahedron |
| Total Number of Dimples: 432 | Total Number of Dimples: 402 |
| Number of Uninterrupted Parting Lines: | Number of Uninterrupted Parting Lines: |
| Several | One |

Three flight tests were conducted comparing the flight characteristics of the instant invention, i.e., the Large Core Golf Ball, with a control sample, the XS Distance Golf Ball.

EXAMPLE 1

| Ball | Driver Test #1739 Carry (yards) Total (yards) | Driver Test #1738 Carry (yards) Total (yards) | 8-Iron Test #1748 Carry (yards) Total (yards) |
|---|---|---|---|
| Large Core | 245.3 | 248.5 | 140.0 |
| Golf Ball | 255.1 | 270.0 | 140.0 |
| XS Distance | 244.9 | 247.1 | 139.9 |
| Golf Ball | 250.9 | 258.6 | 139.9 |

Advantageously, as is clearly demonstrated by the test results, the use of a golf ball configured according to the aforementioned core, cover and dimple parameters results in a golf ball, the Large Core Golf Ball, which has longer flight characteristics than the control sample.

Figure 10:
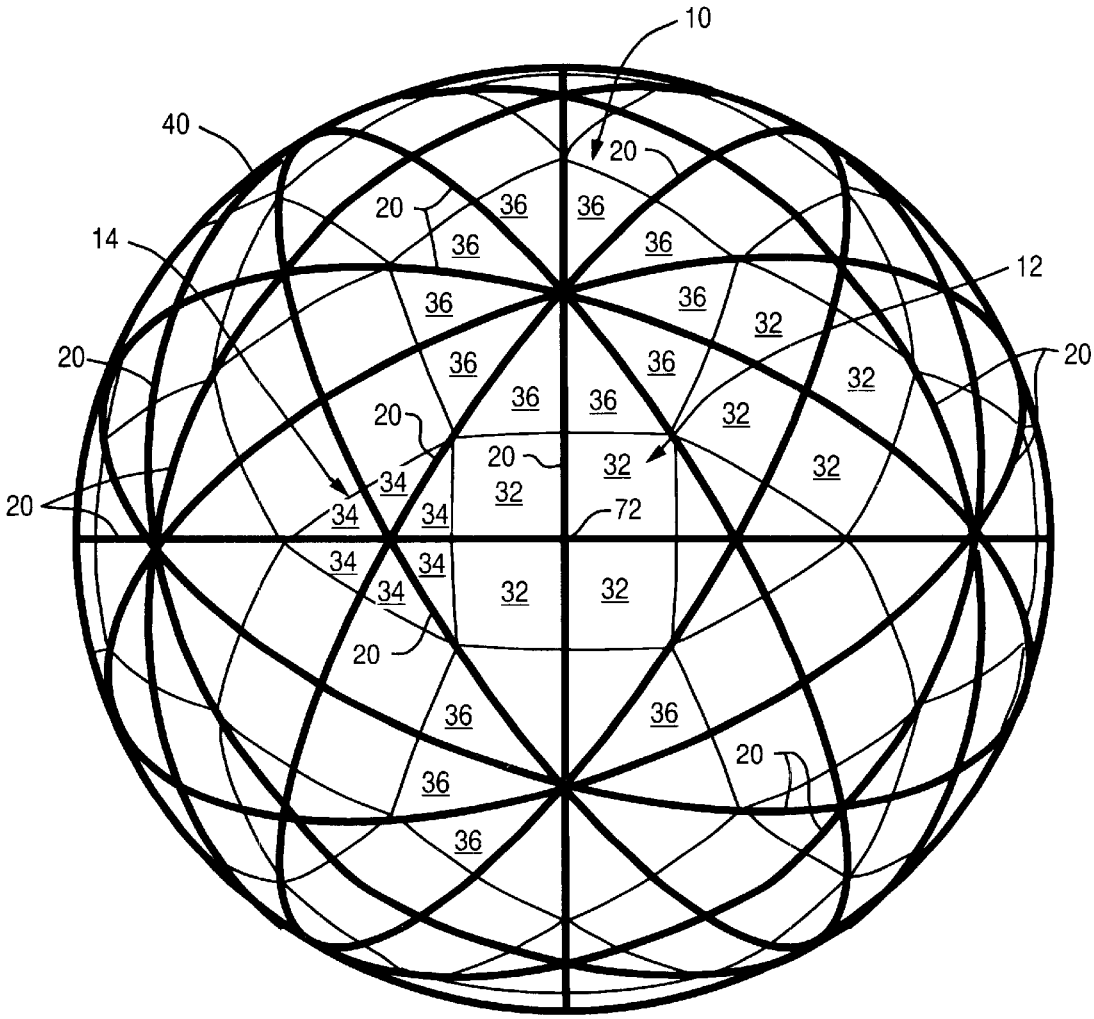
FIG. 10 is an elevation view of the outer surf ace of the golf ball being further divided by a plurality of parting lines of the polygonal configurations to form another embodiment of the invention.

A secondary partitioning of the outer surface of the golf ball is superimposed on the rhombicosadodecahedron previously described, as illustrated in FIG. 10. For this embodiment the two poles 72 are located at the center of squares and the mold line 40 is formed as illustrated in FIG. 3. This second partitioning is realized by forming parting lines or bisectors 20 along great circle paths that essentially divide each pentagon 10 into ten (10) smaller triangles 36 of equal size. These parting lines 20 also divide each square into four (4) smaller squares 32 and each triangle 14 into six smaller triangles 34. This further division of the outer surface of the golf ball allows the location of dimples over a greatly expanded number of polygonal configurations. It further allows a mold line 40 to be selected to correspond with any one of the parting lines 20 to create a true mold line and fourteen false mold lines.

Figure 11:
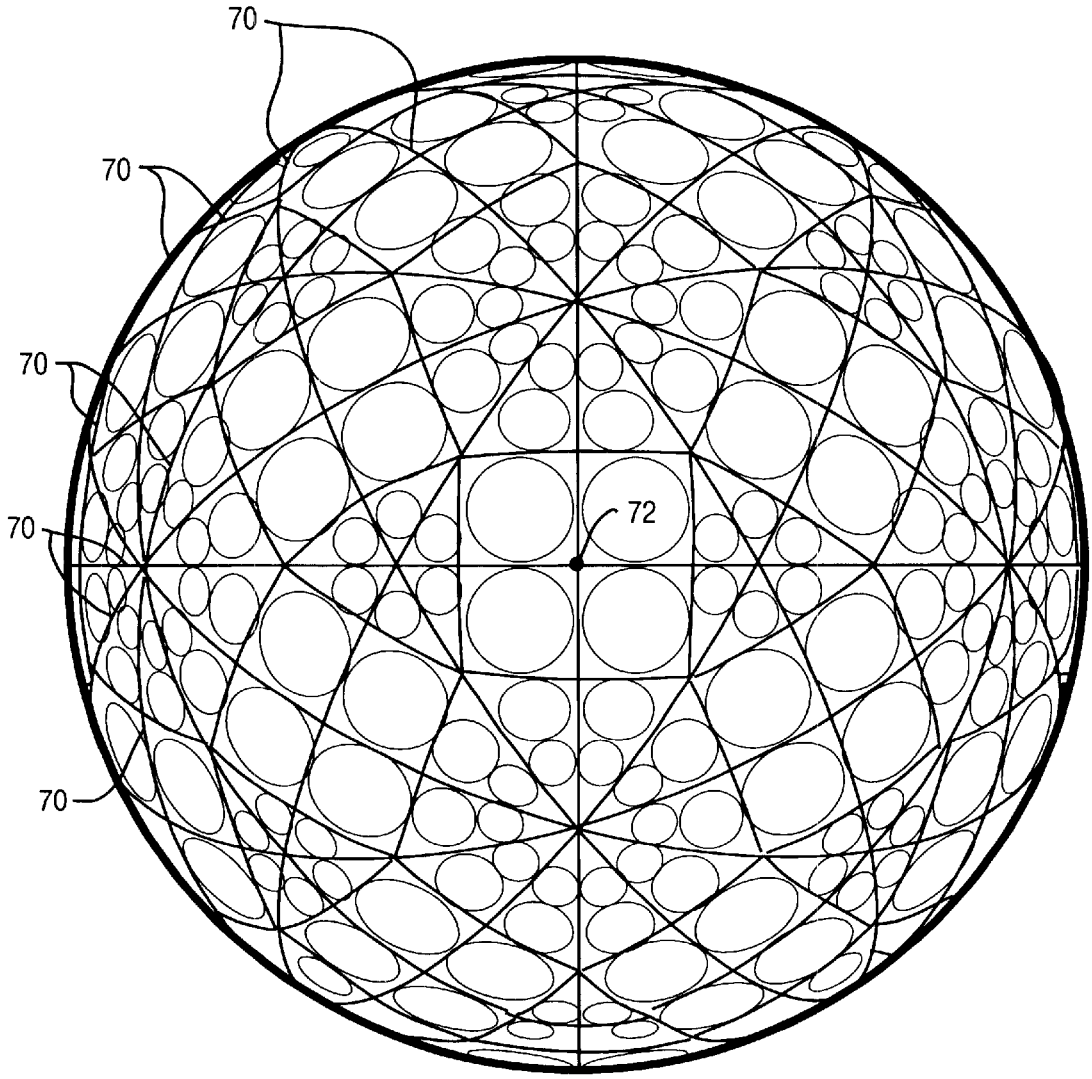
FIG. 11 is an elevation view of the golf ball showing dimples located on the outer surface of the golf ball to correspond with the polygonal configurations and parting lines of FIG. 10.
Figure 12:
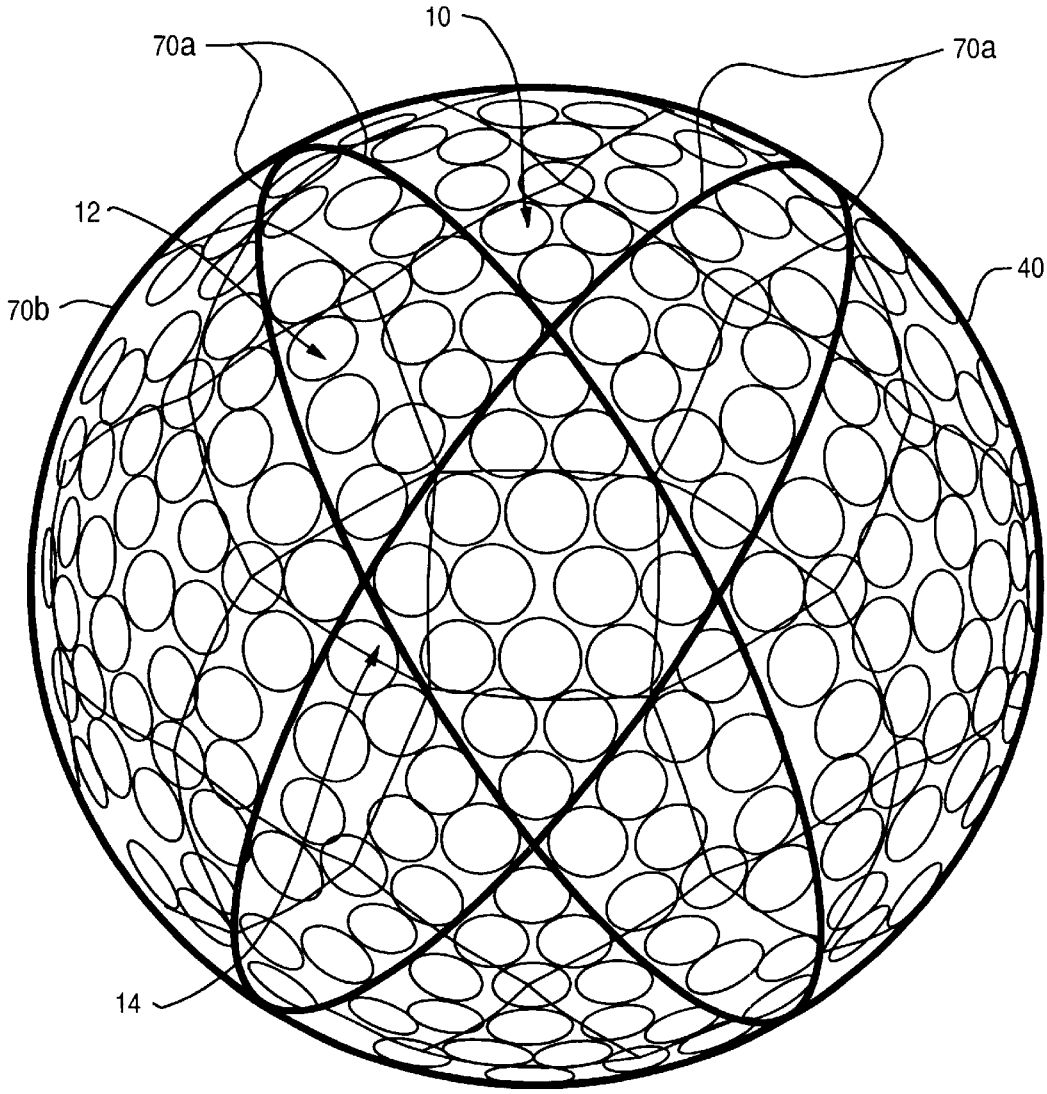
FIG. 12 is an elevation view of the golf ball showing dimples associated with five parting lines on the outer surface of the golf ball to correspond with the polygonal configurations and parting lines of FIG. 2.

A possible dimple pattern for the polygonal configuration of FIG. 10 is illustrated in FIG. 11. For this embodiment the dimples are located within all fifteen of the parting lines 70. That is, none of the parting lines are intersected by any dimple. Three different dimple sizes are shown in FIG. 11; with the largest sized dimples located within the squares. This arrangement of dimples is illustrative of having no dimples intersect parting lines. The number of dimples in each of the smaller triangles and squares can be substantially different from the number shown, within the scope of this invention. Dimples are, once again, formed and measured as illustrated in FIG. 9. Another embodiment of the polygonal configurations including certain parting lines is illustrated in FIG. 12. This embodiment uses only five parting lines 70*a* and 70*b* of the fifteen parting lines 20 illustrated in FIG. 10. These certain parting lines are not intersected by any dimples. The mold parting line corresponds to one great circle path 70*b,* as illustrated in the rotated view of the golf ball of FIG. 13. The dimple layout in parts of the outer surface adjacent the five great circle paths may be substantially different than the dimple layout in parts of the outer surface not adjacent the five great circle paths.

Figure 13:
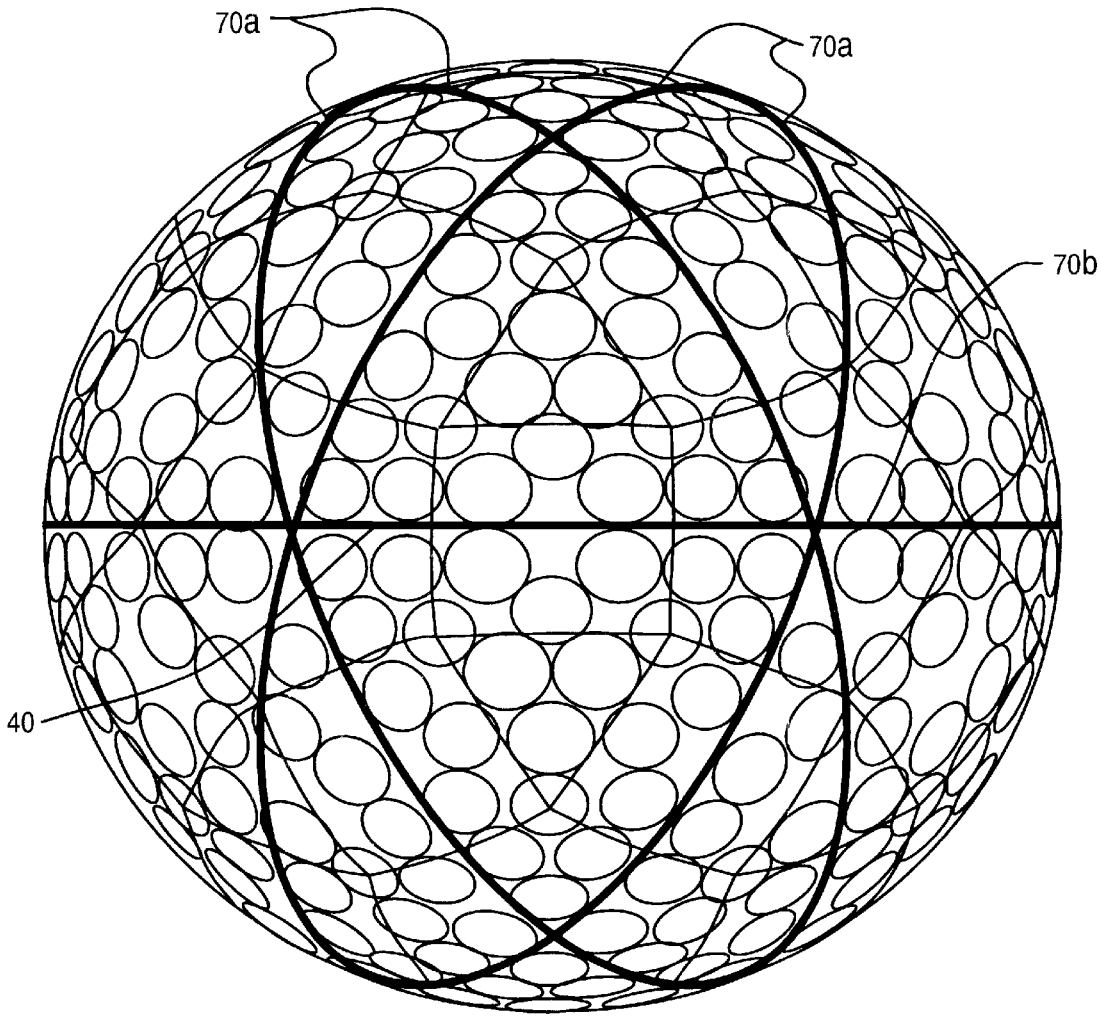
FIG. 13 is an elevation view of the golf ball of FIG. 12 rotated to show an equatorial great circle path defining a mold line.

One example of a dimple layout having dimples approximately equal in size is illustrated in FIGS. 12 and 13. Dimple configurations are again defined as illustrated in FIG. 9.

The previous embodiments illustrate dimples, which are formed as generally circular in a plan view of each dimple.

Figure 14:
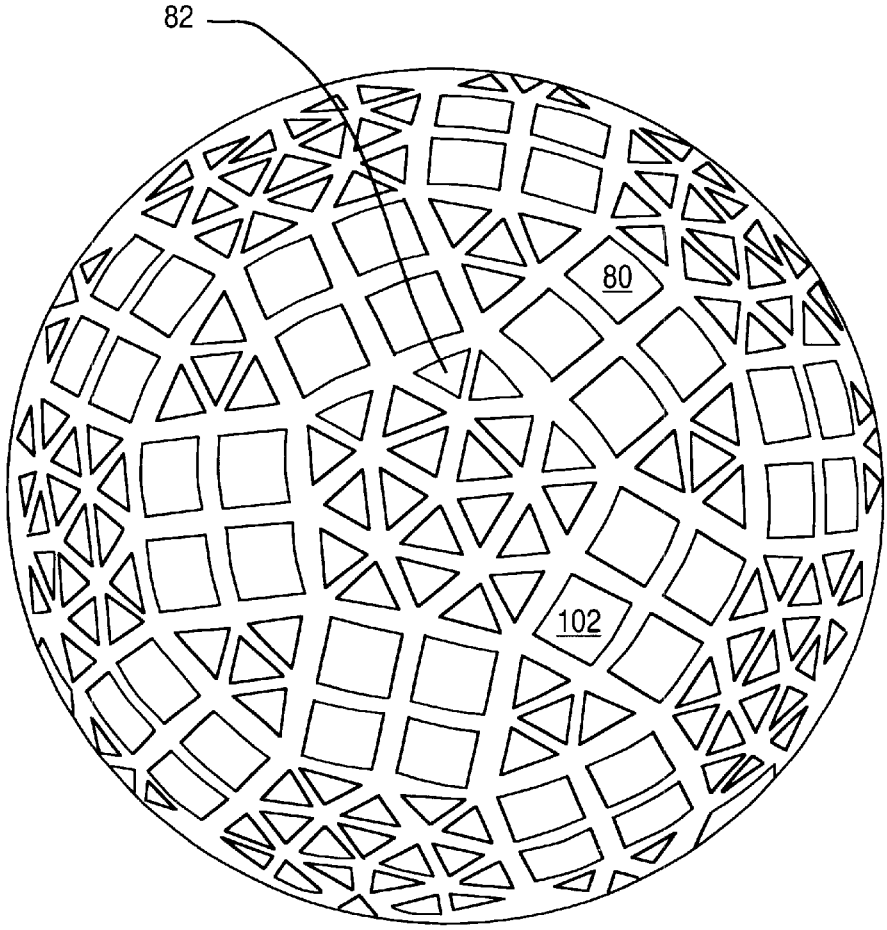
FIG. 14 is an elevation view of the golf ball showing non-circular dimples, being triangles and squares, located on the outer surface of the golf ball to correspond with the polygonal configurations of FIG. 2.
Figure 15:
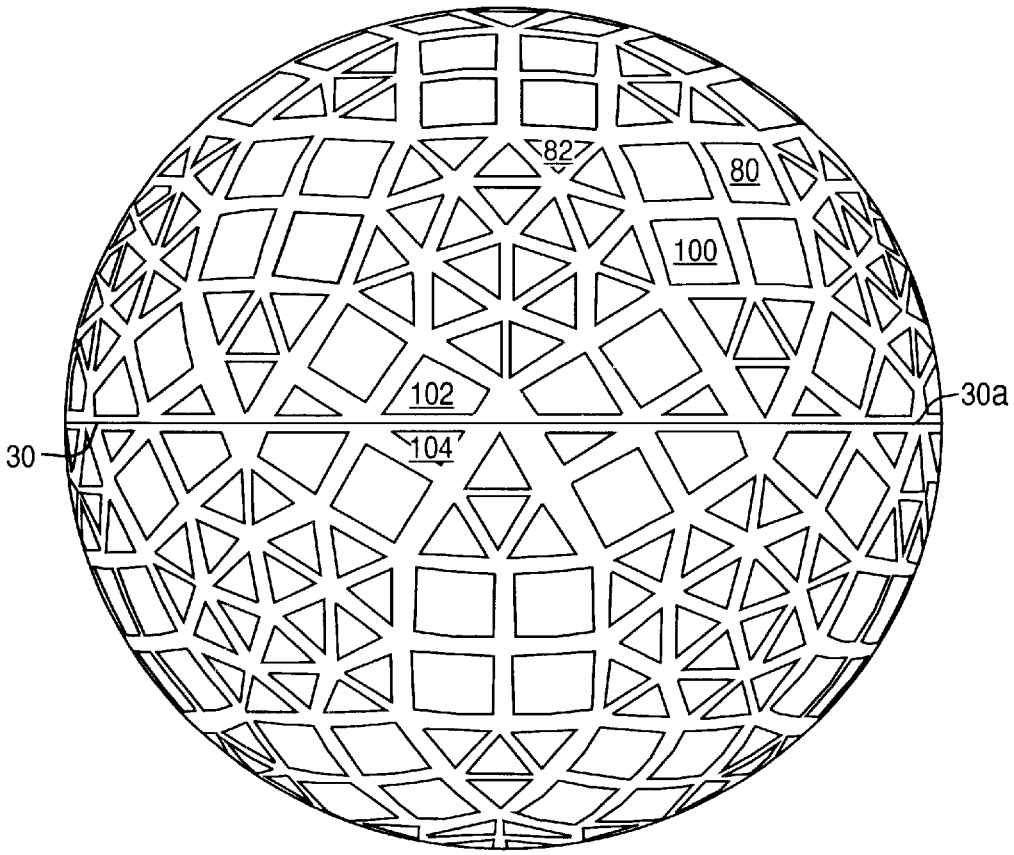
FIG. 15 is an elevation view of the golf ball of FIG. 14 rotated to show an equatorial great circle path defining a mold line.

Other embodiments of the present invention include dimples, which are non-circular in form, as illustrated in FIGS. 14 and 15.

These illustrations show the use of the polygonal configurations of FIG. 2; where the pentagons 10 have twenty (20) triangular shaped dimples, the squares 12 have four square shaped dimples and the triangles 14 have four triangular shaped dimples. The triangular shaped dimples have a height in the range of 0.037 inches to 0.149 inches, and a base in the range of 0.037 inches to 0.149 inches. The squared shaped dimples have a height in the range of 0.037 inches to 0.224 inches and a width in the range of 0.037 inches to 0.224 inches. Dimples at the equatorial great circle path defining a mold parting line 30 are divided into two parts. Each one of the parts appears in a single one of the polygonal configurations. For the embodiment illustrated, the mold line divides certain square shaped dimples 100 within the squares 12 into two parts 102 and 104. A mold parting surface 30*a* is formed by partially eliminating the depression of the certain square shaped dimples adjacent to the mold parting line without changing the general shape or location of these dimples. For example, the two parts 102 and 104 of a parted square dimple are essentially the same size and shape as the square dimple 100. The mold parting surface becomes bounded by parted dimples. The irregular shaped dimples are measured on the basis of spherical shaped dimples having equivalent surface areas and cross sectional areas as set forth above.

The dimples may be placed on the outer surf ace of the golf ball to intersect all of the parting lines constructed on the outer surface, none of the parting lines, or only some of the parting lines on the outer surface. When great circle paths are not intersected by dimples they become true parting lines for defining the dimple pattern.

Figure 8:
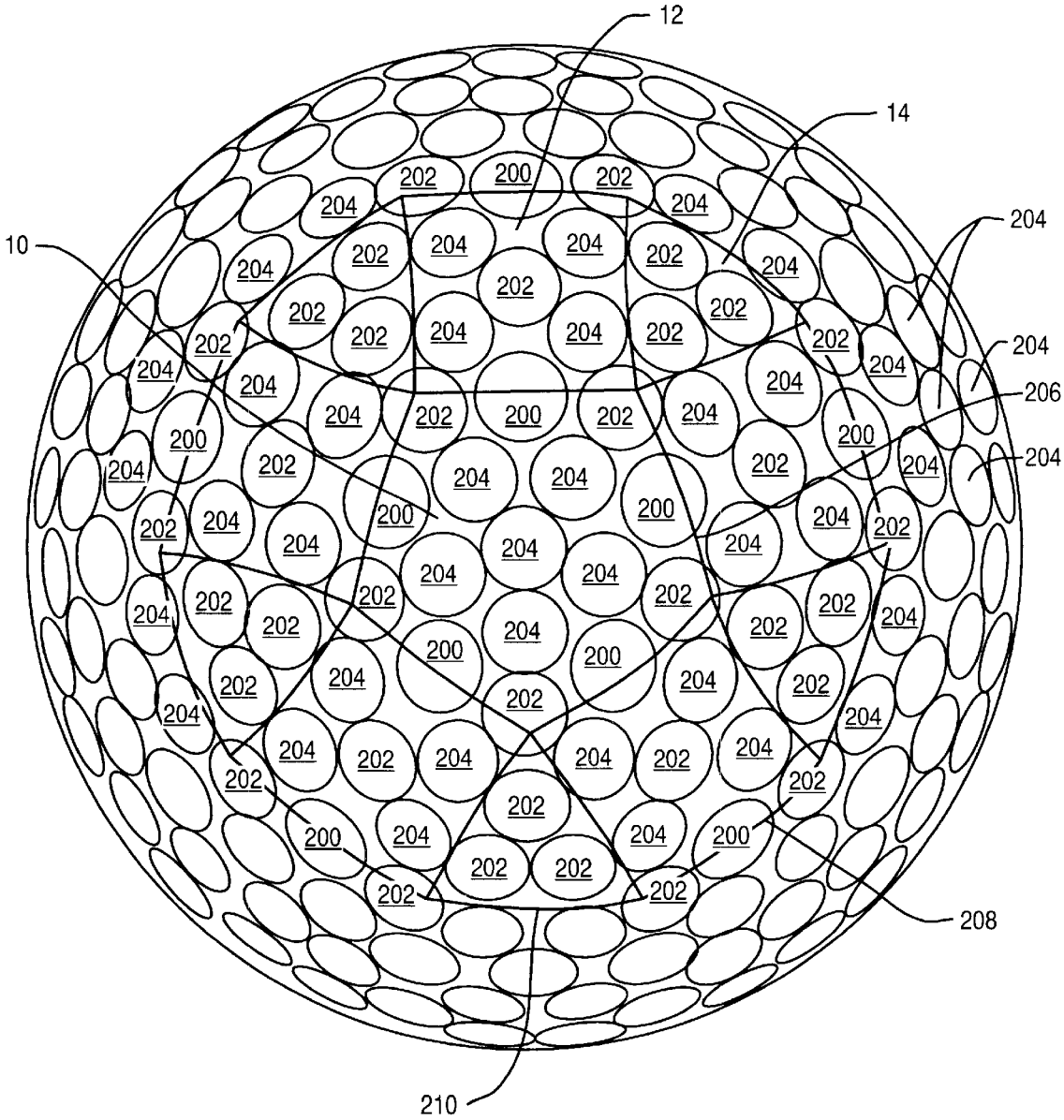
FIG. 8 is a polar view of the ball shown in FIG. 5 and include polygons projected thereon.

FIG. 8 shows all of the parting lines intersected by dimples; FIG. 11 shows none of the parting lines intersected by dimples; and FIG. 12 shows ten of the parting lines intersected by dimples. The dimples sizes for the embodiments shown in FIGS. 11 and 12 may be such that a diameter Dd value is in the range of about 0.13 inches to about 0.15 inches and the depth d has a value in the range of about 0.0055 inches to about 0.0075 inches.

It will be appreciated that the instant specification and claims are set forth by way of illustration and do not depart from the spirit and scope of the instant invention. It is to be understood that the instant invention is by no means limited to the particular embodiments herein disclosed, but also comprises any modifications or equivalents within the scope of the claims.

We claim:

1. A two-piece golf ball comprising:

a core having a compression in the range of about 67 PGA to about 77 PGA;

a cover having a Shore D hardness in the range of about 65 Shore D to about 71 Shore D; and, an outer surface divided into a plurality of polygonal configurations, which include pentagons, squares and triangles wherein said outer surface is divided into a polyhedron defined as a rhombicosadodecahedron; and, a plurality of dimples arranged on the outer surface, with a first pattern of dimples associated with each triangle, a second pattern of dimples associated with each pentagon, and a third pattern of dimples associated with each square.

2. The ball of claim 1 wherein the core has a diameter in the range of about 1.535 inches to about 1.545 inches.

3. The ball of claim 1 wherein the core has a weight in the range of about 35.75 grams to about 36.25 grams.

4. The ball of claim 1 wherein the cover has a composition comprising an ionomeric resin plus color concentrate.

5. The ball of claim 1 wherein the cover has a thickness of about 0.070 inches.

6. The golf ball of claim 1 further comprises 15 great circle paths free of said dimples.

7. The golf ball of claim 1 wherein said dimples are dual radius in cross section.

8. The golf ball of claim 6 wherein said fifteen great circle paths further dividing said outer surface, said fifteen great circle paths combining to essentially divide each pentagon into ten smaller triangles of equal size, each triangle into six triangles of equal size and each square into four smaller squares of equal size to obtain an outer surface consisting of smaller triangles and squares.

9. The golf ball of claim 1 further comprising a first set of dimples, with each dimple in the first set having a first size; a second set of dimples, with each dimple in the second set having a second size; and a third set of dimples, with each dimple in the third set having a third size, wherein the plurality of dimples are selected from the first set of dimples, the second set of dimples, and the third set of dimples.

10. The golf ball of claim 8 wherein sides of each pentagon are intersected by two dimples from the first set of dimples and one dimple from the second set of dimples.

11. The golf ball of claim 9 wherein sides of each square are intersected by at least one dimple from the second set of dimples.

12. The golf ball of claim 9 wherein sides of each triangle are intersected by a dimple from the second set of dimples.

13. The golf ball of claim 1 further comprising:

two poles, an uninterrupted equatorial great circle path that is free of dimples and that defines a mold line symmetrically positioned with respect to said two poles on said outer surface; and a pair of first polygonal configurations each being located on opposite sides of said outer surface to include one of said two poles symmetrically arranged within its boundaries.

14. The golf ball of claim 13 wherein said first polygonal configurations are pentagons.

15. The golf ball of claim 13 wherein said first polygonal configurations are squares.

16. The golf ball of claim 13 wherein said uninterrupted equatorial great circle path is not intersected by any dimples.

17. The golf ball of claim 1 wherein the total number of dimples is at least 402.

18. A two-piece golf ball comprising a core having a compression in the range of about 67 PGA to about 77 PGA;

a cover having a Shore D hardness in the range of about 65 Shore D to about 71 Shore D; and an outer surface divided into a plurality of polygonal configurations, which include pentagons, squares and triangles wherein said outer surface is divided into a polyhedron defined as a rhombicosadodecahedron; and a plurality of dimples arranged on the outer surface, with a first pattern of dimples associated with each triangle, a second pattern of dimples associated with each pentagon, and a third pattern of dimples associated with each square wherein said dimples are essentially circular with each one of said dimples having a size defined by a diameter in the range of about 0.13 inches to about 0.14 inches, and a depth in the range of about 0.0054 inches to about 0.0064 inches.

19. The golf ball of claim 17 further comprising fifteen great circle paths for further dividing said outer surface, said parting lines combining to essentially divide each pentagon into ten smaller triangles of equal size, each triangle into six triangles of equal size and each square into four smaller squares of equal size to obtain an outer surface consisting of smaller triangles and squares.

20. The golf ball of claim 17 further comprising five great circle paths that do not intersect any dimples.

21. The golf ball of claim 17 wherein the dimples are non-circular and are selected from a group consisting of triangles and squares.

22. The golf ball of claim 21 wherein the triangular shaped dimples have a height in the range of 0.037 inches to 0.149 inches, and a base in the range of 0.037 inches to 0.149 inches, and the squared shaped dimples have a height in the range of 0.037 inches to 0.224 inches and a width in the range of 0.037 inches to 0.224 inches.

* * * * *

UNITED STATES PATENT AND TRADEMARK OFFICE

CERTIFICATE OF CORRECTION

PATENT NO. : 6,428,428 B1
DATED : August 6, 2002
INVENTOR(S) : Kuttappa et al.

It is certified that error appears in the above-identified patent and that said Letters Patent is hereby corrected as shown below:

Column 13, lines 11-25, through Column 14, lines 1-5,
Claim 17 and 18, should read:

17. A two-piece golf ball comprising:

a core having a compression in the range of about 67 PGA to about 77 PGA; a cover having a Shore D hardness in the range of about 65 Shore D to about 71 Shore D; and an outer surface divided into a plurality of polygonal configurations, which include pentagons, squares and triangles wherein said outer surface is divided into a polyhedron defined as a rhombicosadodecahedron; and a plurality of dimples arranged on the outer surface, with a first pattern of dimples associated with each triangle, a second pattern of dimples associated with each pentagon, and a third pattern of dimples associated with each square wherein said dimples are essentially circular with each one of said dimples having a size defined by a diameter in the range of about 0.13 inches to about 0.14 inches, and a depth in the range of about 0.0054 inches to about 0.0064 inches.

18. The golf ball of claim 1 wherein the total number of dimples is at least 402.

Signed and Sealed this

Twenty-first Day of January, 2003

JAMES E. ROGAN
*Director of the United States Patent and Trademark Office*